US007104040B2

(12) United States Patent
Bertoli et al.

(10) Patent No.: US 7,104,040 B2
(45) Date of Patent: Sep. 12, 2006

(54) FLUFF REDUCING DEVICE IN TEXTILE YARNS

(75) Inventors: Luciano Bertoli, Fiume Veneto (IT); Giovanni Gardin, Zoppola (IT); Guido Belforte, Turin (IT); Terenziano Raparelli, Turin (IT); Francantonio Testore, Turin (IT); Vladimir Viktorov, Turin (IT); Alexandre Ivanov, Turin (IT); Andrea Trivella, Turin (IT); Matteo Martinelli, Turin (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 160 days.

(21) Appl. No.: 10/827,735

(22) Filed: Apr. 19, 2004

(65) Prior Publication Data

US 2004/0211858 A1 Oct. 28, 2004

(30) Foreign Application Priority Data

Apr. 28, 2003 (IT) ..... MI2003A0846

(51) Int. Cl.
*B65H 57/00* (2006.01)

(52) U.S. Cl. ..... 57/350; 57/352

(58) Field of Classification Search ..... 57/350, 57/352

See application file for complete search history.

(56) References Cited

U.S. PATENT DOCUMENTS

| | | | | |
|---|---|---|---|---|
| 3,448,570 | A * | 6/1969 | Stoller | 57/350 |
| 4,624,102 | A | 11/1986 | Bell, Jr. | |
| 4,858,288 | A | 8/1989 | Hodgin et al. | |
| 5,263,311 | A | 11/1993 | Feil et al. | |
| 5,351,472 | A | 10/1994 | Ohashi | |
| 6,332,311 | B1 * | 12/2001 | Todo et al. | 57/350 |

FOREIGN PATENT DOCUMENTS

EP 1 013 803 6/2000

OTHER PUBLICATIONS

EP Search Report.

* cited by examiner

*Primary Examiner*—Shaun R. Hurley
(74) *Attorney, Agent, or Firm*—Hedman & Costigan; James V. Costigan

(57) ABSTRACT

Device for reducing the fluff of a yarn comprising a longitudinal duct for the passage of the yarn, and ducts for the injection of air, tangential to the yarn, forming a vortex in accordance with the yarn twist, without the interposition of deviation and control means for generating a balloon.

14 Claims, 5 Drawing Sheets

FLUFF REDUCING DEVICE IN TEXTILE YARNS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention refers to the catching and bobbin winding of the yarn produced or processed by textile machines.

In the industrial production of yarns, it is customary to process and catch them by winding them onto a tube to form bobbins, which are then transferred to subsequent processing steps and for use.

After effecting these processes on the yarn, there is a significant amount of fluff, i.e. fibers which are not well twisted into the yarn body with the result that one of their ends protrudes therefrom. For some of the subsequent processing operations or use of the yarns, such as spooling or various kinds of weaving, this fluffing can be an obstacle for the processability and/or harmful for the quality of the end product, and must therefore be removed or reduced before use. Said fluffing is normally attributed to the incomplete twist and retention of the fibers in the yarn body, and to the fact that it is induced by the same processes effected on the yarn, during which it is in contact with other elements and is subjected to mechanical strains, such as contacts, impact, wipings, abrasions, de-torsions, deviations, centrifugal forces and so on, as well as to effects and stress of the electrostatic or pneumatic type.

A considerable increase in the fluffing of yarn under processing can generally be observed, along its run from the feeding pirn to the winding bobbin of the purified yarn, during yarn finishing processes, or during crosswinding in automatic crosswinding machines for purifying the yarn from its defects. Crosswinding is in fact effected by processing the yarn at high linear rates, normally around 20–30 m/sec, and the mechanical stress on the yarn is normally thought to be the reason for an increase in fluffing. In general terms, the higher the winding rate, the higher the increase in fluffing during the run of the yarn from the pirn to the bobbin. For this reason, fluff suppressing devices have been proposed in the state of the art, to be inserted along the run of the yarn of automatic crosswinding machines.

(2) Description of Related Art

A fluff suppressing process is presented in U.S. Pat. No. 5,263,311 in the name of the Institute of Textile Technology. This process reduces the fluffing of spun yarn by inducing, along the yarn, an air vortex with an axial component opposite to the yarn direction. The vortex rotation is directed in a counter direction to the twist of the yarn. A fluff suppressing device of analogous concept is presented by U.S. Pat. No. 5,351,472 in the name of Murata. This device also operates by means of air vortexes on the yarn, in a cylindrical duct having a longitudinal slit for the insertion and disinsertion of the spun yarn.

Nozzles are positioned on said cylindrical duct, for injecting air in a tangential direction with respect to the passage of the yarn, as well as control means of the balloon induced on the yarn, for containing and controlling it in its longitudinal extension at the duct outlet.

According to the subsequent patent application EP 1,013,803 in the name of Murata, the fluff suppressing device is equipped with a closing mechanism of the tangential slit for the yarn insertion. Sucking means are also envisaged in the duct—in addition to the blowing nozzles—to remove powder and short fibres, detached by the action of the blowing nozzles, from the spun yarn already inside the duct itself.

BRIEF SUMMARY OF THE INVENTION

Means for the regulation and control of the balloon are also envisaged, in order to limit its extension within the duct and prevent its propagation outside. This fluff reducing technique seems to be based on the rotating balloon effect, which generates a false twisting effect: the yarn is first subjected to de-twisting, to free and detach, as a result of the centrifugal effect, the shorter fibres protruding from the yarn which is spinning at a high velocity, and remove them, and subsequently to a new twisting of the longer protruding fibres which have not been detached, thus twisting them again onto the yarn.

These balloon regulation means are situated close to the duct and consist of plates with V-shaped slits which induce sudden deviations of the spun yarn thus preventing the balloon from propagating and allowing it to develop and swell up within the interval thus delimited by the deviating plates.

The transversal dimension of the duct in which the balloon is developed, is therefore much bigger than the transversal dimension of the yarn to be processed, in order to have a dimension sufficient for the development of the balloon, with the consequent effect of the false twisting described above.

In the known technique, the methods and devices for fluff reduction in spun yarns, to be installed in automatic crosswinding machines, obtain the result of partially removing the protruding fibers which cause the fluffing, but have the disadvantage of generating, in the run of the yarn from the pirn to the bobbin, other contact points and sudden directional deviations of the yarn which cause a further production of fluff. Another drawback is that the shape of these fluffing reducing devices requires a high consumption of compressed air for their functioning.

In the following description—in order to illustrate in the best possible way the problems faced and technical solutions proposed by means of the present invention—reference is made to the yarn run scheme from the pirn to the bobbin in an automatic crosswinding machine produced by the applicant, for illustrative but non-limiting purposes, with the explicit notification that the present invention may be advantageously used for reducing yarn fluff also on winding machines using different treatment technologies.

FIG. 1 shows the side view of the run scheme of the yarn in a bobbin winder station 1, whose shape is indicated by the dotted line in its most significant components. Proceeding from the bottom upwards, the station starts with the feeding bobbin 2, from which the yarn 3 is unwound, which rotates as a vortex around the bobbin with a balloon which is controlled through the funnel-shaped balloon breaker 4.

From this point, the yarn 3 passes into the first deviator 5 and to the thread tension device 6, consisting of two opposite rotating disks, which are pressed against each other with an adjustable force. After the thread tension device 6, the yarn encounters a second deviator 7 before the thread guide plate 8. The deviators 5 and 7 consist of two plates with a V-shaped groove for centering the yarn, in which a gasket made of porcelain, or a similar material, is generally inserted, to reduce friction and wear.

According to its first embodiment, the fluff suppressing device 10 according to the present invention, can be inserted between the thread tension device 6 and the second deviator 7. It is described hereunder, with respect to its structure, functioning and components, making reference to FIGS. 2 and 3.

After the second deviator 7, the thread 3 encounters the thread guide plate 8, the component which detects the yarn defects and activates the organs dedicated to their removal, by cutting and eliminating the faulty pieces, and by joining the resulting yarn ends, in order to continue the processing of the thread after restoring its continuity.

After passing through the guide plate 8, the spun yarn 3 is wound onto the collecting bobbin 12, which operates resting and rotating on the driving roller 13, which makes the bobbin rotate at a constant linear rate.

The joining organ of the yarn ends consists of the thread connector 15 shown with a dotted line. Said thread connector is served by two mobile mouthpieces for catching and delivering the yarn ends. The yarn end catching mouthpiece 16 at the side of the spool 2, can have a bi-directional rotation shown by the arrow A, to catch the yarn end from the side of the feeding spool and direct it to the thread connector 15, with an anti-clockwise rotation following the path 17, in the position shown with the dotted line. The yarn end catching mouthpiece 18 at the side of the tapered bobbin 12, can have a bi-directional rotation shown by the arrow B, to catch the yarn end from the side of the bobbin produced, in the position shown with the dotted line, and then direct it to the thread connector 15, with a clockwise rotation, following the path 19.

The objective of the present invention is to provide a device and process for reducing yarn fluff, which overcomes the drawbacks of the yarn fluff reducing devices and processes of the known art and allows yarns to be obtained with reduced fluffing at lower investment and running costs.

The yarn fluff reducing device according to the invention is defined, in its main components, in the first claim, whereas its variants and preferential embodiments are defined and specified in the dependent claims thereof.

The yarn fluff reducing process according to the invention is defined, in its main parameters, in claim 14.

In order to illustrate with greater clarity the characteristics and advantages of the present invention, this is described with reference to some of its typical embodiments, shown in FIGS. 1 to 5 for illustrative and non-limiting purposes.

Said figures refer to an embodiment of the fluff suppressing device, according to the invention, to deliver a thread to the winding tapered bobbin 12, from which most of the fluff has been eliminated, which it would otherwise have at the exit of the spun yarn run described with reference to FIG. 1.

DETAILED DESCRIPTION OF THE INVENTION

Figure 1:
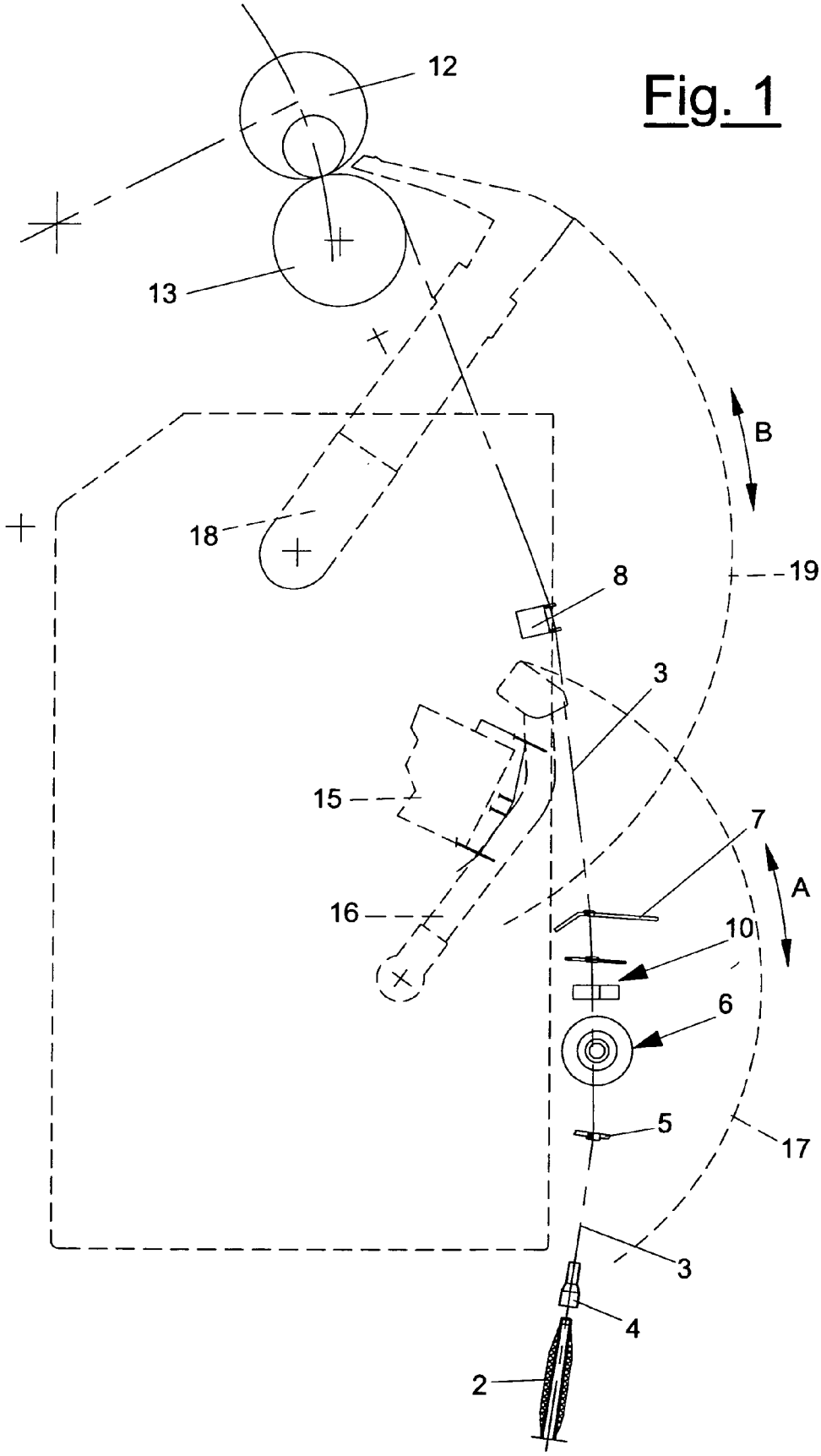
FIG. 1 is a side view of the run scheme of the yarn in a bobbin winder station (1), whose shape is indicated by the dotted line in its most significant components.
Figure 2:
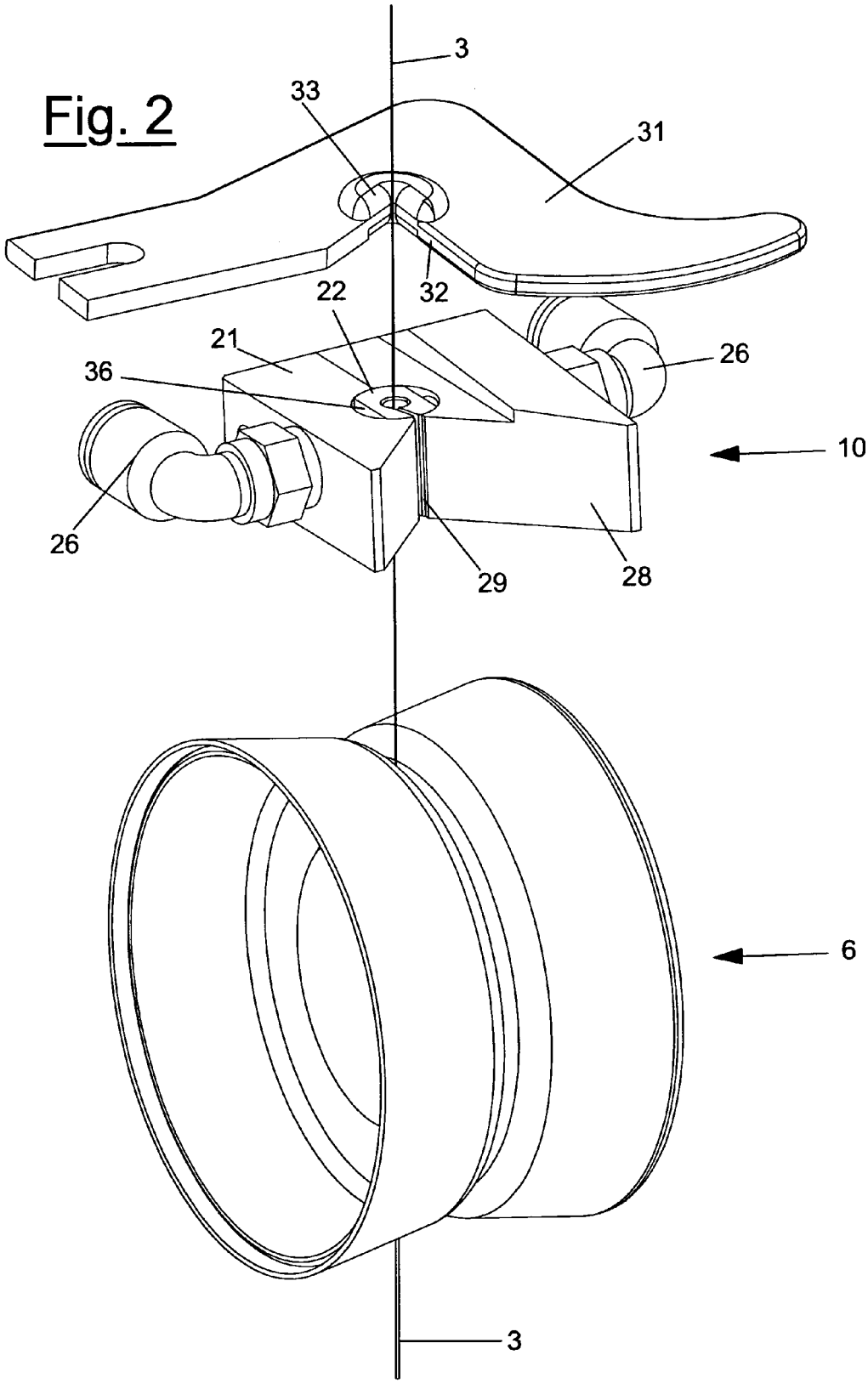
FIG. 2 is a semi diagrammatic perspective illustrating the major components of the invention: the spindle (6), yarn (3), thread guide plate (10) and guiding organ (31).
Figure 3:
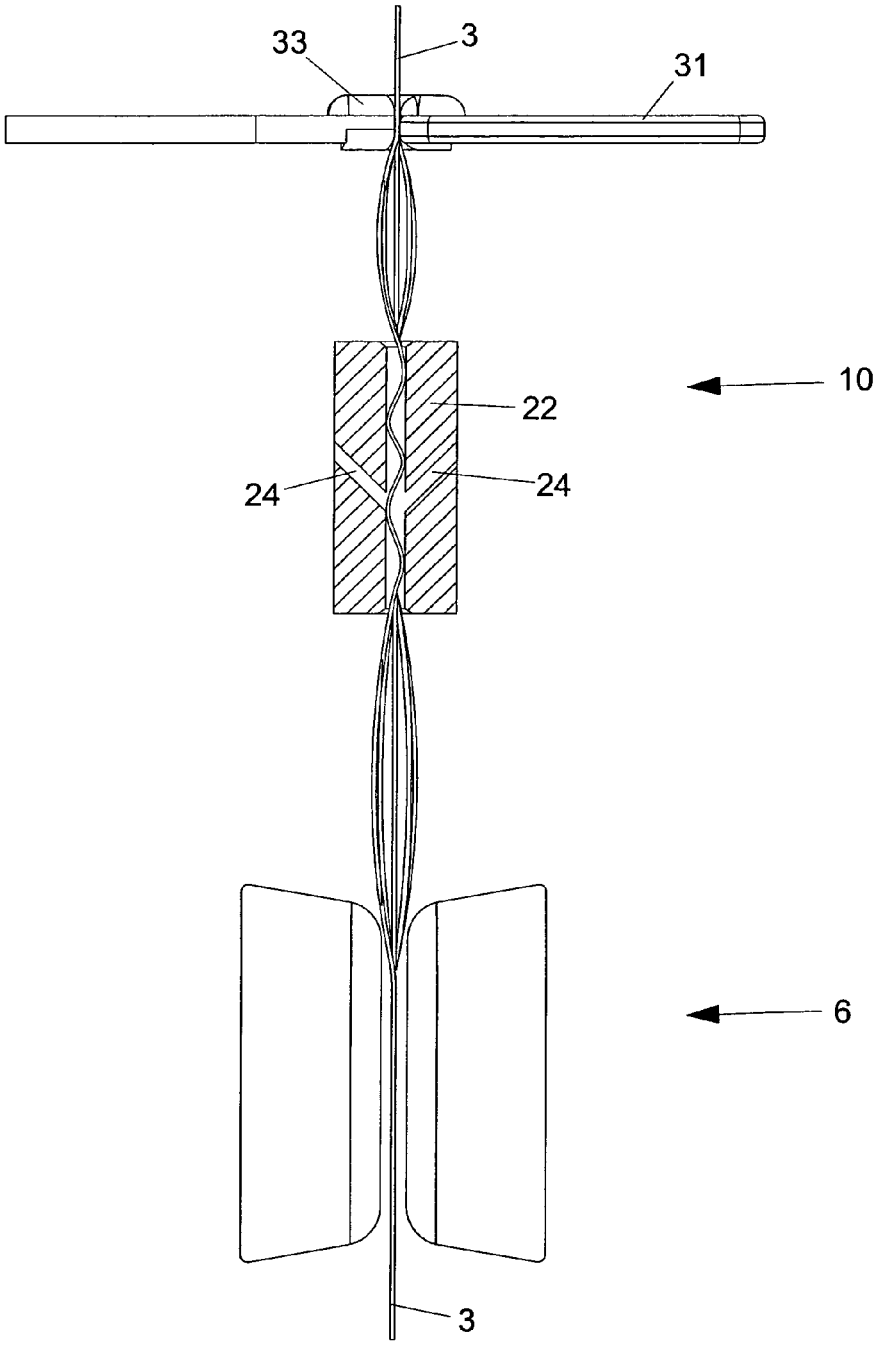
FIG. 3 is a semi diagrammatic front view of the perspective illustrated in FIG 2.
Figure 3:
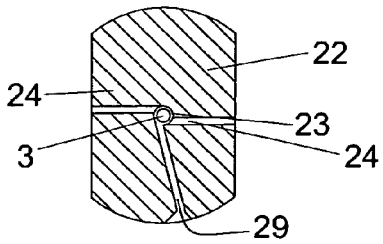

The thread guide plate 10 is shown in its main components in FIGS. 2 and 3. In this illustrative embodiment, it is placed in the position shown in FIG. 1, above the disks of the thread tension device 6 and within the field of action of the mouthpiece 15 for catching the thread at the spool side. In the thread tension device 6, the yarn 3 runs upwards; it is grasped and constrained in the drawing plane of FIG. 3, but it can move into the plane of the opposite disks of the thread tension device.

The fluff reducing or suppressing device comprises a nozzle-holding block 21, in which the treatment nozzle 22 is inserted, containing a cylindrical and longitudinal duct 23 into which the spun yarn 3 runs at a high speed. One or more fluid adduction ducts 24, under pressure, run inside the duct 23, for example service compressed air, which is sent to the nozzle-holder block 21 by the connectors 26.

The pressure of the service compressed air is generally 1–6 bars and the diameter of the ducts 24 is about 0.5 mm. The length of the duct 23 is generally within the range of 8–20 mm.

As shown in the lower part of FIG. 3, which illustrates the transversal section of the nozzle 22, the ducts 24 are situated in opposite positions and are tangentially oriented with respect to the longitudinal duct 23, generating an essentially rotational stress on the fibrils protruding from the spun yarn 3 which runs at a high speed inside.

An outstanding characteristic of the device according to the invention is that the air vortex induced by means of the ducts 24 has the same direction as the twist produced on the yarn during its original spinning, so as to twist the protruding fibrils and bring them back into the spun yarns, and not de-twisting, releasing and removing them, as the known technique describes. Only the shortest fibrils, which are not well rooted in the fibrous body of the yarn, can escape as a result of being torn from the yarn. The outlets of the ducts 24 are preferably in an orthogonal direction to the duct 23, so as to maximize the rotatory component of the air flow with respect to the axial component.

A V-shaped slit 28 is made on the front side of block 21, which allows the yarn to enter the duct 23 with the longitudinal slit 29 open and extending along its whole length. This inlet is suitable for returning the spun yarn 3 back into the duct 23 during its joining operation in the thread connector 15, so that the yarn is inside the duct 23 after each intervention for eliminating a defect from the spun yarn being processed and when the bobbin winding operation is restarted.

Another guiding organ 31, for the correct re-entering of the yarn into the slit 29, is situated, at a suitable vertical distance, above the nozzle-holding block 21. This guiding organ 31 consists of a widely open slit 32 having at the bottom a gasket 33 made of porcelain or other material, similar to that of the deviators 5 and 7.

This gasket 33 acts as a guide for the re-entering of the yarn but, once the bobbin winding of the spun yarn has re-established regime conditions, it does not induce any appreciable deviation of the yarn and does not act as a balloon controller or reducer, as in the case of the deviators conceived by the state of the art mentioned above. According to the present invention, no deviation or control means of the yarn being processed are placed around the device 10. A salient feature of the device according to the invention, is that the transversal dimension of the duct 23 is not much greater than that of the yarn under processing. Generally speaking, the diameter of the duct 23 can range between 5 and 15 times the nominal diameter of the yarn to be processed. In this way the stress induced by the compressed air jets introduced by means of the ducts 24, is not sufficient to significantly develop a balloon inside the duct 23: it induces, on the other hand, an air vortex around the yarn which runs without twisting in the same direction as this vortex, or rather without a significant formation of a balloon and without the consequent actions of false twisting mentioned above. The fluff reduction action of the yarn is, in fact, more efficient in the absence of the balloon, i.e. when the yarn does not follow a loop course with a rotational motion with respect to the direction of the yarn path, and therefore without moving in concordance with the air vortex which induces it, as happens, on the contrary, with the formation of the balloon.

A plausible explanation for this behavior may be that, under these conditions, the compressed air, due to its whirling motion inside the duct, reaches the maximum relative rotational rate with respect to the spun yarn and against the protruding fibrils, thus reducing its fluffing.

As already described, the fluff reducing process according to the invention, envisages that the air flow induced by the ducts 24 corresponds to the twist of the yarn under processing, so as to re-twist the protruding fibrils, and lead them back into the yarn, letting, at the most, only the shortest and less rooted fibrils in the fiber body, escape.

For this reason, the containment cavity 36 is arranged in the nozzle-holding block 21, in which the nozzle 22 having a duct 23 of a suitable shape and dimension according to the yarn under process, is assembled each time.

The course of the yarn 3 within the fluff preventing device 10 according to the invention, is not subjected to constraints or directional variations in the interval between the deviators 5 and 7, where the device is inserted. The stress transmitted to the yarn inside the duct 23, can consequently propagate and be released in the external tracts, both upstream towards the thread tension device 6 and downstream towards the deviator 7, without causing a significant formation and maintenance of the balloon. At the most, at the normal operating rates within the range of 800–1800 m/min, an elongated balloon can be formed, not stable and not very apparent in the two external parts of the nozzle 22, indicatively indicated in FIG. 3.

This arrangement is illustratively shown in FIGS. 2 and 3, with a significant distance left between the nozzle 22 both towards the thread tension device 6 and the guiding organ 31. Again in general terms, the distances between the nozzle 22 and each of the adjacent organs, i.e. the disk thread tension device 6 and the guiding organ 31, are longer several times the length of the duct 23. The only significant deviations and constraints for the stress induced with the air injected into the fluff preventing device, are those of the deviators 5 and 7.

The yarn fluff reducing process according to the present invention therefore consists in passing said spun yarn into the duct 23 of the nozzle 22, at the processing rate, inducing thereon a transversal air flow, causing a vortex having the same rotational direction as the yarn twist, and preventing or limiting the yarn from following a balloon trend, rotating in accordance with the compressed air. In this way the air has the maximum relative velocity with respect to the yarn and winds around the central body the part of the fibrils protruding from the same.

The non-formation or limitation of the balloon is obtained by eliminating, in the device according to the present invention, any significant deviation of the yarn near the fluff preventing device. The devices of the known technique, on the contrary, develop and blow up the balloon inside the interval delimited by the deviation blocks, pursuing the effects of the false twist and centrifugal force. The effect of the centrifugal force is in fact harmful, as it extracts the fibers which are not well secured from the central body of the yarn, thus forming further fluffing and tearing away other fluff which causes powder on the machine walls.

Figure 4:
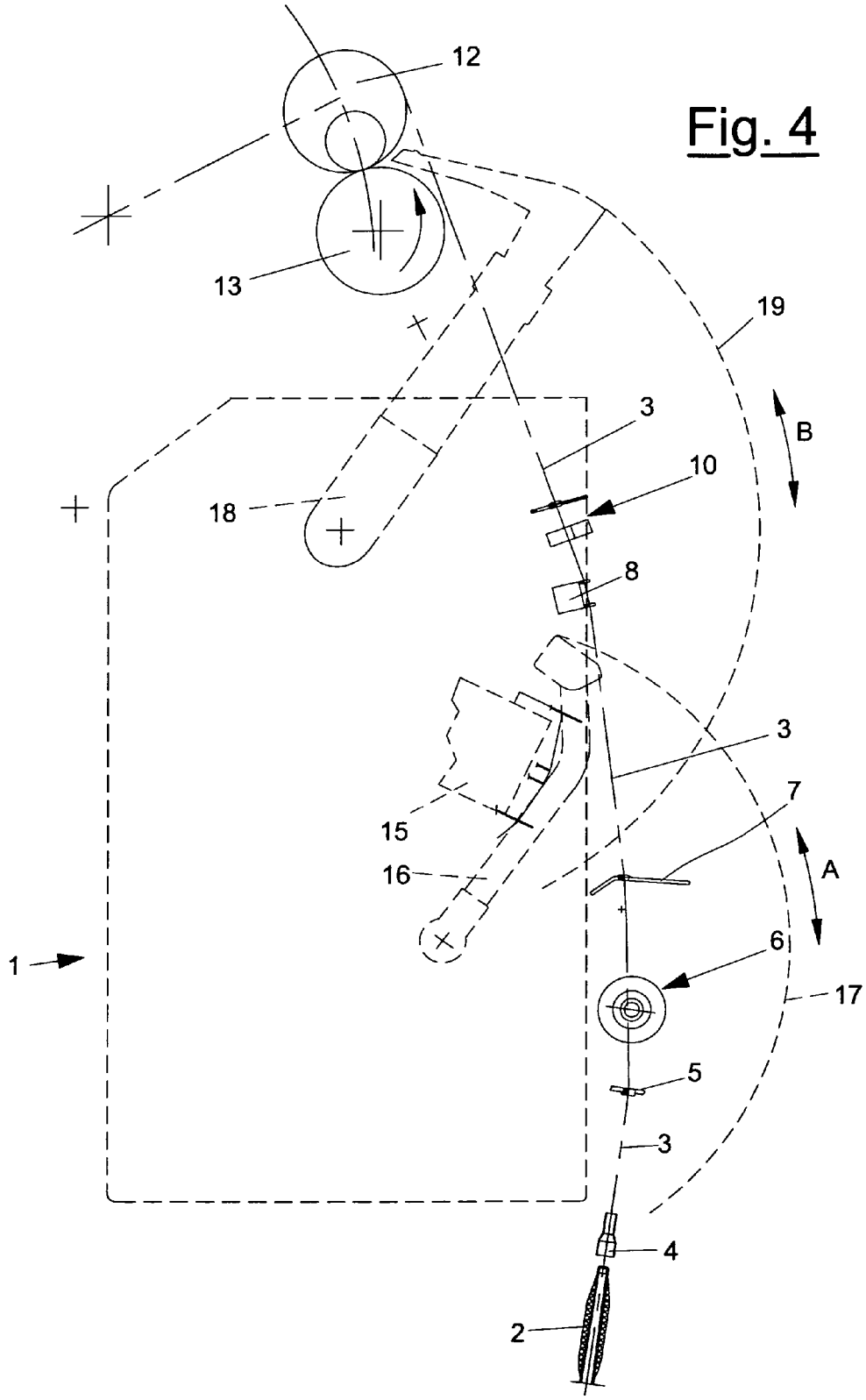
FIG. 4 is a side view of an alternate embodiment run scheme of the fluff suppressing device in a different position on the run of the yarn from the prin to the bobbin.

According to an alternative embodiment of the present invention, the fluff preventing device is placed in the position indicated in FIG. 4, in the final straight tract of the course of the yarn 3 above the guide plate 8 and within the field of action of the mouthpiece 18 for the collection of the yarn end from the side of the spool.

According to this alternative embodiment, the fluff removal treatment is carried out at the point with the highest output, in the tract where there is the greatest presence of fluff, after the yarn has been subjected to all deviation stress, shocks and scratching and is collected on the bobbin 12.

Figure 5:
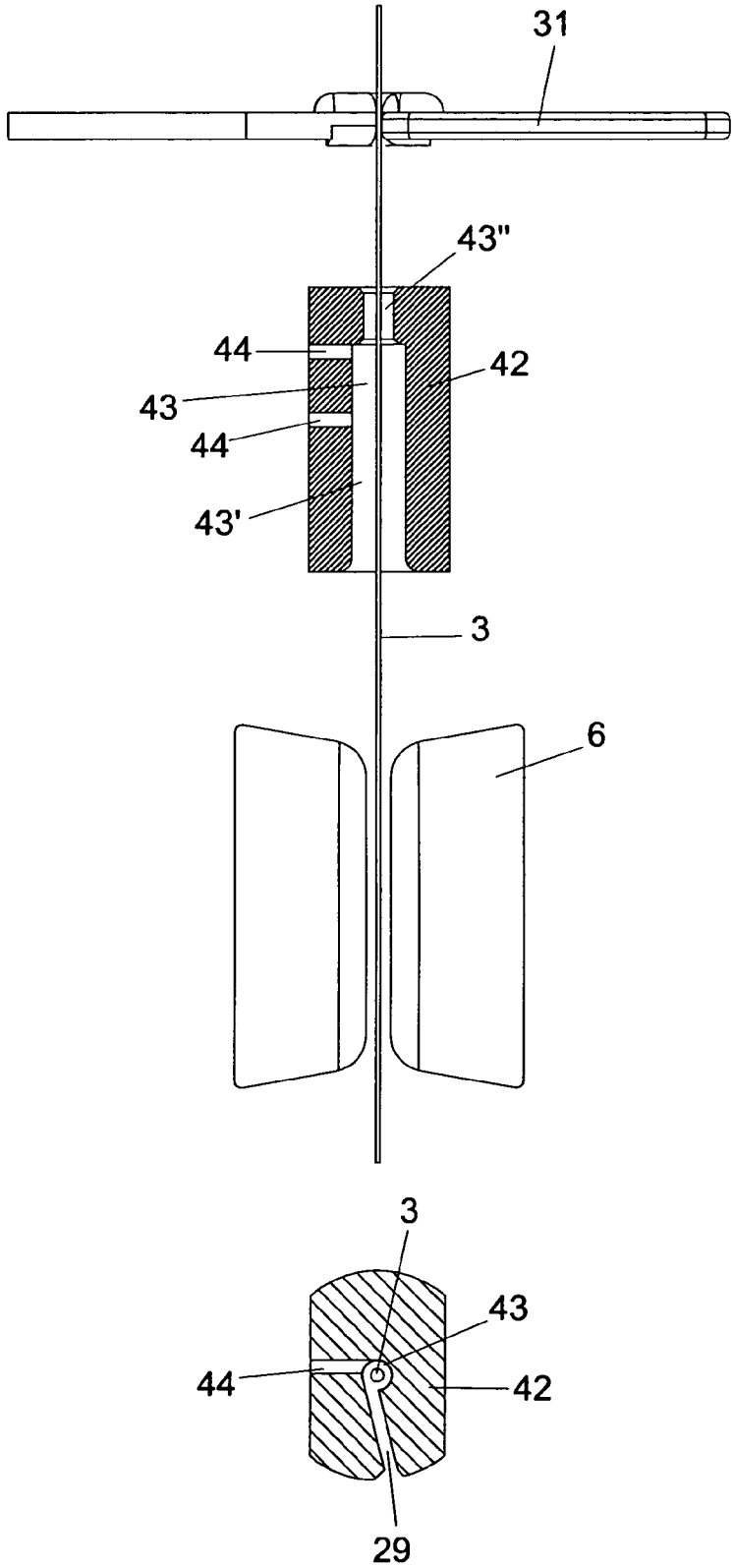
FIG. 5 is a semi-diagrammatic front view of a preferred embodiment in which the thread guide plate (10), is replaced with a treatment nozzle (42).

FIG. 5 shows a preferential embodiment of the fluff preventing device according to the present invention.

This embodiment envisages the use of a treatment nozzle 42, which contains a cylindrical and longitudinal duct 43 through which the yarn 3 runs upwards at high speed. The duct 43 is divided into two coaxial cylindrical tracts 43' and 43" having a different diameter. One or more ducts 44, carrying fluid under pressure, run into the first, lower tract 43', which is longer and with greater diameter with respect to the subsequent duct 43", preferably in its upper part and with a direction substantially orthogonal to the thread 3 direction. FIG. 5 shows two tangential and superimposed ducts 44.

The second, upper tract 43", with a smaller diameter, restricts the dimension of the yarn 3 passage and its diameter is about 40–90% with respect to the lower tract 43', preferably within the range of 45–65%. The length of the upper tract 43" ranges from 10 to 30% of the whole length of the tract 43, whereas the length of the other tract 43' occupies the remaining 70–90% of the overall length.

This nozzle configuration has proved to be particularly effective in limiting the formation of undesired balloons and in the removal of fluff by rewinding it onto the thread 3.

The narrowing of the duct 43" and the introduction of compressed air through the ducts 44 connected to the upper part of the duct 43', which is longer and with a greater diameter, allow the vortex effect induced on the yarn to be fully exploited. The greater dimension of the duct 43' favours the axial discharge of the compressed air from the lower part and allows the action of the air vortex to be effective on the whole length of said tract 43', which is longer, before being discharged outside the duct.

According to a preferred embodiment, the discharge hole of the lower duct 44 has a smaller diameter with respect to that of the upper duct 44, in order to reinforce and stabilize the air vortex moving downwards. The fluff reducing device of the spun yarns according to the present invention provides a significant progress with respect to the known technique and at least the following aspects deserve particular consideration. The device according to the invention does not require any supplementary contacts and sudden direction deviations of the yarn to be established in its run from the spool to the bobbin, which contribute to the formation of fluff.

These contacts are subsequently also avoided to favour the propagation of stress, also outside the nozzle 22, which eliminates fluffing on the spun yarn. This stress is obtained with a lower consumption of less compressed air.

The invention claimed is:

1. Fluff reducing device (10) of a spun yarn (3), to be inserted on the path of the thread of a winding machine from the feeding pirn (2) to the tapered bobbin (12), comprising a nozzle (22) in which a duct (23, 43) is inserted which defines a longitudinal track of the yarn under process and one or more air injection ducts (24, 44) in a tangential direction with respect to the yarn (3) movement in the duct (23) characterized in that the air flow induced by means of said ducts (24, 44) corresponds to the twist of the yarn being processed, the duct (23) comprises an open longitudinal slit (29) along its entire length and no yarn (3) deviation and control means are interposed around the device (10).

2. The fluff reducing device of a spun yarn (3) according to claim 1, characterized in that the ends of the ducts (24,44) are preferably oriented in an orthogonal direction with respect to the longitudinal duct (23, 43).

3. The fluff reducing device of a spun yarn (3) according to claim 1, characterized in that the diameter of the duct (23) ranges from 5 to 15 times the nominal diameter of the yarn to be processed.

4. The fluff reducing device of a spun yarn (3) according to claim 1, characterized in that the duct (23,43) is situated in a nozzle (22), which, in turn, is held by the nozzle-holding block (21), in which a containment cavity (36) has been formed, on which the nozzle (22) is assembled each time, having a duct (23, 43) of a suitable shape and size for the yarn being processed.

5. The fluff reducing device of a spun yarn (3) according to claim 1, characterized in that the ducts (24) are opposite each other and tangentially oriented with respect to the longitudinal duct (23).

6. The fluff reducing device of a spun yarn (3) according to claim 1, characterized in that the ducts (44) are superimposed and tangential with respect to the longitudinal duct (43).

7. The fluff reducing device of a spun yarn (3) according to claim 1, characterized in that the duct (43) is divided into two cylindrical tracts (43', 43") having a different diameter.

8. The fluff reducing device of a spun yarn (3) according to claim 7, characterized in that the second tract (43") is the upper one, having a diameter equal to 40–90% of the diameter of the lower tract (43').

9. The fluff reducing device of a spun yarn (3) according to claim 8, characterized in that the second tract (43") has a diameter equal to 45–65% of the diameter of the lower tract (43').

10. The fluff reducing device of a spun yarn (3) according to claim 7, characterized in that the length of the upper tract (43") is from 10 to 30% of the total length of the duct (43), whereas the length of the other tract (43') occupies the remaining 70–90% of the total length.

11. The fluff reducing device of a spun yarn (3) according to claim 10, characterized in that the ducts (44) are placed in the upper part of duct (43') which is longer and has a greater diameter.

12. The fluff reducing device of a spun yarn (3) according to claim 1, characterized in that a guiding organ (31) is placed above the nozzle (22) for the correct entering of the yarn into the slit (29) which does not induce any significant deviation of the yarn when the winding bobbin is under regime conditions.

13. The fluff reducing device of a spun yarn (3) according to claim 1, characterized in that the fluff prevention device (10) is placed in the final straight tract of the yarn (3) path and above a thread guiding plate (8).

14. A fluff reducing process of a yarn (3) along the path of a tapered bobbin yarn, from the feeding bobbin (2) to the tapered bobbin (12), consisting in passing the yarn being processed into a longitudinal duct (23, 43) and injecting into said duct one or more compressed air flows in a tangential direction with respect to the movement of the yarn (3) in the duct (23, 43), characterized in that the air flows generate a vortex with a torque in accordance with the processed yarn (3) twist, and that the fluff reduction is carried out without any substantial formation of a yarn (3) balloon.

* * * * *